US011808269B2

(12) United States Patent
Wikström

(10) Patent No.: US 11,808,269 B2
(45) Date of Patent: Nov. 7, 2023

(54) DRAINAGE PUMP ASSEMBLY AND METHOD FOR CONTROLLING A DRAINAGE PUMP

(71) Applicant: Xylem Europe GmbH, Schaffhausen (CH)

(72) Inventor: Jan Wikström, Sundbyberg (SE)

(73) Assignee: Xylem Europe GmbH, Schaffhausen (CH)

( * ) Notice: Subject to any disclaimer, the term of this patent is extended or adjusted under 35 U.S.C. 154(b) by 263 days.

(21) Appl. No.: 17/047,274

(22) PCT Filed: Apr. 12, 2019

(86) PCT No.: PCT/EP2019/059542

§ 371 (c)(1),
(2) Date: Oct. 13, 2020

(87) PCT Pub. No.: WO2019/201803

PCT Pub. Date: Oct. 24, 2019

(65) Prior Publication Data

US 2021/0164476 A1 Jun. 3, 2021

(30) Foreign Application Priority Data

Apr. 17, 2018 (EP) ..... 18167714

(51) Int. Cl.
*F04D 13/08* (2006.01)
*F04D 15/00* (2006.01)

(52) U.S. Cl.
CPC ..... *F04D 15/0066* (2013.01); *F04D 13/08* (2013.01)

(58) Field of Classification Search
CPC .... F04D 13/08; F04D 15/006; F04D 15/0027; F04D 15/02; F04D 15/0209; F04D 15/0218; F04D 15/0254; F04D 15/0281
See application file for complete search history.

(56) References Cited

U.S. PATENT DOCUMENTS

2005/0123408 A1* 6/2005 Koehl ..... F04D 15/02 417/53
2010/0034665 A1* 2/2010 Zhong ..... F04D 15/0218 417/42

(Continued)

FOREIGN PATENT DOCUMENTS

WO 2006136200 A1 12/2006

OTHER PUBLICATIONS

International Search Report and Written Opinion for International Application No. PCT/EP2019/059542, dated Jun. 26, 2019, 9 pages.

*Primary Examiner* — Connor J Tremarche
(74) *Attorney, Agent, or Firm* — RatnerPrestia

(57) ABSTRACT

A method for controlling a drainage pump configured to operate at a variable operational speed, and a drainage pump assembly so controlled. The drainage pump has a drive unit including an electrical motor and a drive shaft, and a hydraulic unit with an impeller operatively connected to the electrical motor via the drive shaft. The method includes continuously operating the drainage pump at a positive operational speed with default operation at a predetermined idle operational speed, and intermittently detecting whether the drainage pump is snoring or not snoring. The operational speed is decreased by one step when snoring is detected, and increased by one step when snoring is not detected.

20 Claims, 2 Drawing Sheets

(56) References Cited

U.S. PATENT DOCUMENTS

| | | | | |
|---|---|---|---|---|
| 2011/0200450 | A1* | 8/2011 | Shelley | F04B 49/08 417/1 |
| 2016/0174531 | A1* | 6/2016 | Boothe | F04D 13/0686 119/260 |

* cited by examiner

DRAINAGE PUMP ASSEMBLY AND METHOD FOR CONTROLLING A DRAINAGE PUMP

CROSS-REFERENCE TO RELATED APPLICATIONS

This patent application is a U.S. National Phase Patent Application of PCT Application No. PCT/EP2019/059542, filed Apr. 12, 2019, which claims priority to European Patent Application No. 18167714.7, filed Apr. 17, 2018, each of which is incorporated by reference herein in its entirety.

TECHNICAL FIELD OF THE INVENTION

The present invention relates generally to the field of pumps configured to pump liquid comprising solid matter. Further, the present invention relates specifically to the field of drainage pump assemblies especially configured for pumping liquid comprising sand and stone material, such as drilling water in mining/tunneling applications or surface water on construction sites, i.e. dewatering applications. The drainage/dewatering pump comprises a drive unit having an electric motor and a drive shaft and comprising a hydraulic unit having an impeller operatively connected to said electric motor via said drive shaft. The drainage pump is configured to be operated at a variable operational speed [rpm]. The invention also relates to a method for controlling such a drainage pump.

BACKGROUND OF THE INVENTION

In mines, tunneling, quarries, on construction sites, and the like applications, there is almost always a need to remove unwanted water in order to secure a dry enough environment at the working site. In mining/tunneling/quarries applications a lot of drilling water is used when preparing for charging before blasting, and water is also used to prevent dust spreading after the blasting, and if the production water is not removed at least the location of the blast and the lower parts of the mine will become flooded. Surface water and groundwater will also add up to accumulation of unwanted water to be removed. It is customary to use drainage/dewatering pumps to lift the water out of the mine to a settling basin located above ground, and the water is lifted stepwise from the lower parts of the mine to different basins/pits located at different depths of the mine. Each step/lift may for instance be in the range 25-50 meters in the vertical direction, and the length of the outlet conduit, i.e. the transport distance, in each step/lift may for instance be in the range 100-300 meters. In mining applications a considerable amount of sand and stone material is suspended in the water, in some applications as much as 10%.

Generally the site manager, and the process at the working site, requires a constant low liquid level and therefor the drainage pump is in constant operation even though there is only little water available in the cavity/basins. Thus, in many applications the drainage pumps are in constant operation, irrespective of water being pumped or not. Constant operation of the drainage pump may damage the drainage pump and result in excessive energy consumption. If there is no or little inflow of water to the cavity housing the drainage pump, the drainage pump will start to heat the water, an operational mode referred to as boiling. During boiling, the elevated temperature in the drainage pump and in the water is especially harmful for the seals, and eventually all water will become evaporated. The combination of high operational speed and snoring accelerates pump wear and significantly shortens the operative life of the drainage pump.

In other applications, the drainage pump is operated in an ON/OFF-manner, i.e. stopped when the water level in the specific basin housing the drainage pump is low, for instance the drainage pump is stopped when the drainage pump is snoring. The drainage pump is snoring when a mixture of air and water is sucked into the drainage pump. The drainage pump is stopped to decrease the use of energy when the drainage pump is not able to perform any positive duty, i.e. when snoring. However, a great disadvantage is to know when to re-start the pump and thereto the re-start of the drainage pump involves an initial power peak.

OBJECT OF THE INVENTION

The present invention aims at obviating the aforementioned disadvantages and failings of previously known drainage pumps, and at providing an improved drainage pump. A primary object of the present invention is to provide an improved drainage pump of the initially defined type that is configured to be operated in an operational mode significantly reducing the wear of the drainage pump, at the same time as a low liquid level is assured in the cavity/basin. It is another object of the present invention to provide a drainage pump that is configured to be operated in an operational mode reducing the energy consumption.

SUMMARY OF THE INVENTION

According to the invention at least the primary object is attained by means of the initially defined drainage pump assembly and method having the features defined in the independent claims. Preferred embodiments of the present invention are further defined in the dependent claims.

According to a first aspect of the present invention, there is provided a method of the initially defined type, which is characterized by the steps of continuously operating the drainage pump at a positive operational speed, the impeller being driven in rotation by said electric motor in a positive direction of rotation, default operating the drainage pump at an operational speed equal to a predetermined idle operational speed (OPidle), and periodically increasing the operational speed of the drainage pump from the idle operational speed (OPidle) to a predetermined snoring detection threshold (OPdetect) and detecting whether the drainage pump is snoring or not at the snoring detection threshold (OPdetect). When snoring is detected at the snoring detection threshold (OPdetect), the operational speed of the drainage pump is decreased to the idle operational speed (OPidle) whereby the default operation of the drainage pump at the idle operational speed (OPidle) is resumed, and when snoring is not detected at the snoring detection threshold (OPdetect), proceed to stepwise change of the operational speed of the drainage pump and at each new operational speed detecting whether the drainage pump is snoring or not, wherein the stepwise change of the operational speed involves: increasing the operational speed one step each time snoring is not detected, at most up to a predetermined maximum operational speed (OPmax), and decreasing the operational speed one step each time snoring is detected, at most down to the idle operational speed (OPidle) whereby the default operation of the drainage pump at the idle operational speed (OPidle) is resumed.

According to a second aspect of the present invention, there is provided a drainage pump assembly comprising a drainage pump and a control unit configured to execute the steps of the inventive method.

Thus, the present invention is based on the insight of using snoring detection in combination with an intelligent drive to vary the operational speed of the drainage pump to be as low as possible in view of the available amount of liquid/water, and thereby the drainage pump will be subject to less wear and the energy consumption will decrease.

According to a preferred embodiment of the present invention, the snoring detection threshold (OPdetect) is equal to or higher than a predetermined minimum operational speed (OPmin), the drainage pump being configured to transport liquid at operational speeds equal to or higher than the minimum operational speed (OPmin), i.e. able to perform positive duty. Thereby a quick detection whether the drainage pump is snoring or not will be accomplished.

According to a preferred embodiment of the present invention, the drainage pump, each time the operational speed is decreased to the idle operational speed (OPidle), is operated at the idle operational speed (OPidle) equal to or longer than 5 seconds and equal to or shorter than 60 seconds. The time between increased inflow of water can vary and be minutes or several hours, but when the inflow of water starts to increase the drainage pump has to react/respond promptly, almost instantaneously.

According to a preferred embodiment of the present invention, the step of detecting whether the drainage pump is snoring or not during the stepwise change of the operational speed is performed on or after 1 second from the time the operational speed starts to decrease or increase and within 10 seconds from the time the operational speed starts to decrease or increase. The shorter time in the range entails that the impeller of the drainage pump, following a speed change, has time to reach the new operational speed before a new snoring detection is performed but the drainage pump might not have reached a steady state. Each change in operational speed is made by ramping up or down in order to prevent water hammer. A longer time entails that the drainage pump reaches a new steady state before a new snoring detection is performed in order to filter out false snoring detection. However, a too long time entails that the liquid level may rise too much and/or the time of snoring operation at the new operational speed will lead to increased wear.

According to a preferred embodiment of the present invention, the idle operational speed (OPidle) of the drainage pump is equal to or higher than 1 [rpm] and equal to or lower than 100 [rpm]. An as low as possible idle operational speed will further decrease the wear of the drainage pump and further decrease the energy consumption.

According to a preferred embodiment, the electric motor of the drainage pump is operatively connected to a control unit, and most preferably said control unit is integrated into the drainage pump. This means that the drainage pump only need to be connected to a power mains via an electrical cable, and regarding the control the drainage pump is autonomous.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

The present invention relates specifically to the field of drainage pumps especially configured for pumping liquid comprising solid matter, such as water comprising sand and stone material. An equivalent term to drainage pump is dewatering pump.

Figure 1:
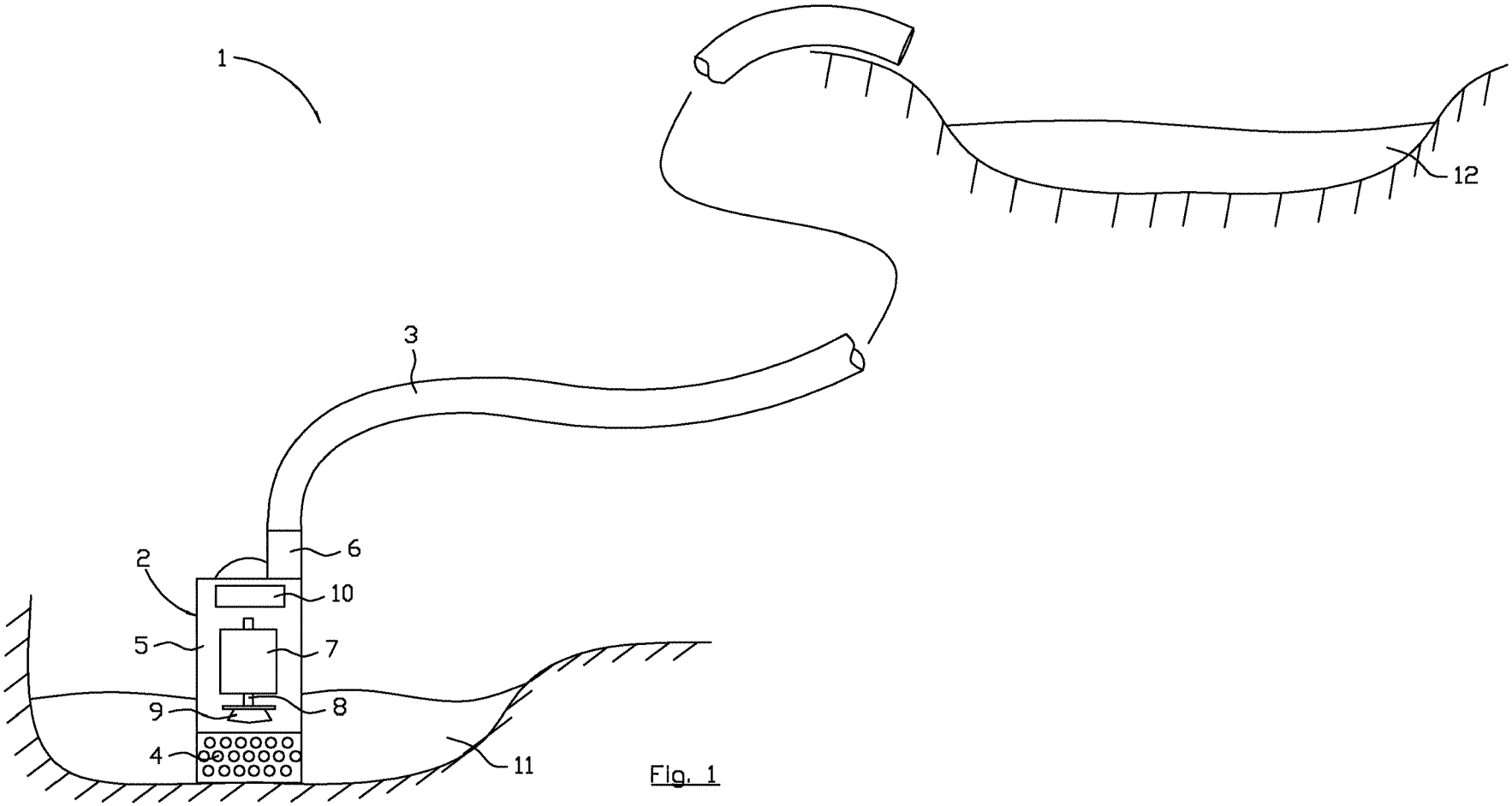
FIG. 1 is a schematic illustration of an inventive drainage pump located in a mine.

Reference is made to FIG. 1, disclosing a schematic embodiment of a drainage pump assembly, generally designated 1. The drainage pump assembly 1 comprises a drainage pump 2 and an outlet conduit 3 that is releasably connected to the drainage pump 2. The drainage pump 2 is preferably of centrifugal pump type.

The disclosed drainage pump 2 comprises an inlet 4, a pump housing 5 and a pump outlet 6. Thereto, the drainage pump 2 comprises in a conventional way a hydraulic unit having a pump chamber/volute (not disclosed), and comprises a drive unit. The drive unit and the pump chamber are arranged in the pump housing 5. The drive unit comprises an electric motor 7 arranged in the liquid tight pump housing 5, and a drive shaft 8 extending from the electric motor 7. The hydraulic unit comprises an impeller 9 that is arranged in the pump chamber and is connected to and driven in rotation by the drive shaft 8 during operation of the drainage pump 2, wherein liquid is sucked into said inlet 4 and pumped out of said outlet 6 when the drainage pump 2 is active. The pump housing 5 and the impeller 9, and other essential components, are preferably made of metal, such as aluminum and steel. The electric motor 7 is powered via an electric power cable extending from a power supply, and the drainage pump 2 comprises a liquid tight lead-through receiving the electric power cable. According to an alternative embodiment, the drive unit comprises an internal combustion engine and a suitable gear box arrangement, wherein the drive shaft is driven in rotation by the internal combustion engine via said gear box arrangement. Drainage pump arrangements comprising internal combustion engines are conventionally used in dry installations, i.e. the entire pump is then located above the liquid surface and an inlet pipe extend from the pump inlet into the liquid.

The drainage pump 2, more precisely the electric motor 7, is operatively connected to a control unit 10, such as an Intelligent Drive comprising an Variable Frequency Drive (VFD). Thus, said drainage pump 2 is configured to be operated at a variable operational speed [rpm], by means of said control unit 10. According to the disclosed and preferred embodiment, the control unit is located inside the liquid tight pump housing 5, i.e. it is preferred that the control unit 10 is integrated into the drainage pump 2. The control unit 10 is configured to control the operational speed of the drainage pump 2. According to an alternative embodiment the control unit is an external control unit. The operational speed of the drainage pump 2 is more precisely the rpm of the electric motor 7 and the impeller 9, and correspond/relate to a control unit 10 output frequency.

The components of the drainage pump 2 are usually cold down by means of the liquid/water surrounding the drainage pump 2. The drainage pump 2 is designed and configured to be able to operate in a submerged configuration/position, i.e.

during operation be located entirely under the liquid surface. However, it shall be realized that the submersible drainage pump 2 during operation must not be entirely located under the liquid surface but may continuously or occasionally be partly located above the liquid surface.

The drainage pump 2 is in the disclosed application located in a first/lower basin 11 and is intended to transport/pump liquid comprising solid matter from said first/lower basin 11 to a second/higher basin 12. Thereto, it shall be realized that it is conceivable that another drainage pump is located in the second basin 12 and intended to transport the liquid from the second basin 12 to a third basin, etc. The basins may be natural recesses/cavities/pits or prepared recesses/cavities/pits.

The present invention is based on the idea to continuously operate the drainage pump 2 at a positive operational speed, intermittently detect whether the drainage pump 2 is snoring or not, wherein the operational speed (OP) of the drainage pump 2 is decreased one step every time snoring is detected and increased one step every time snoring is not detected.

The inventive is an example of a drive mode adapted to save energy and reduce wear, however, it shall be pointed out that the drainage pump may be driven in other drive modes, such as constant operation at the rated power.

Figure 2:
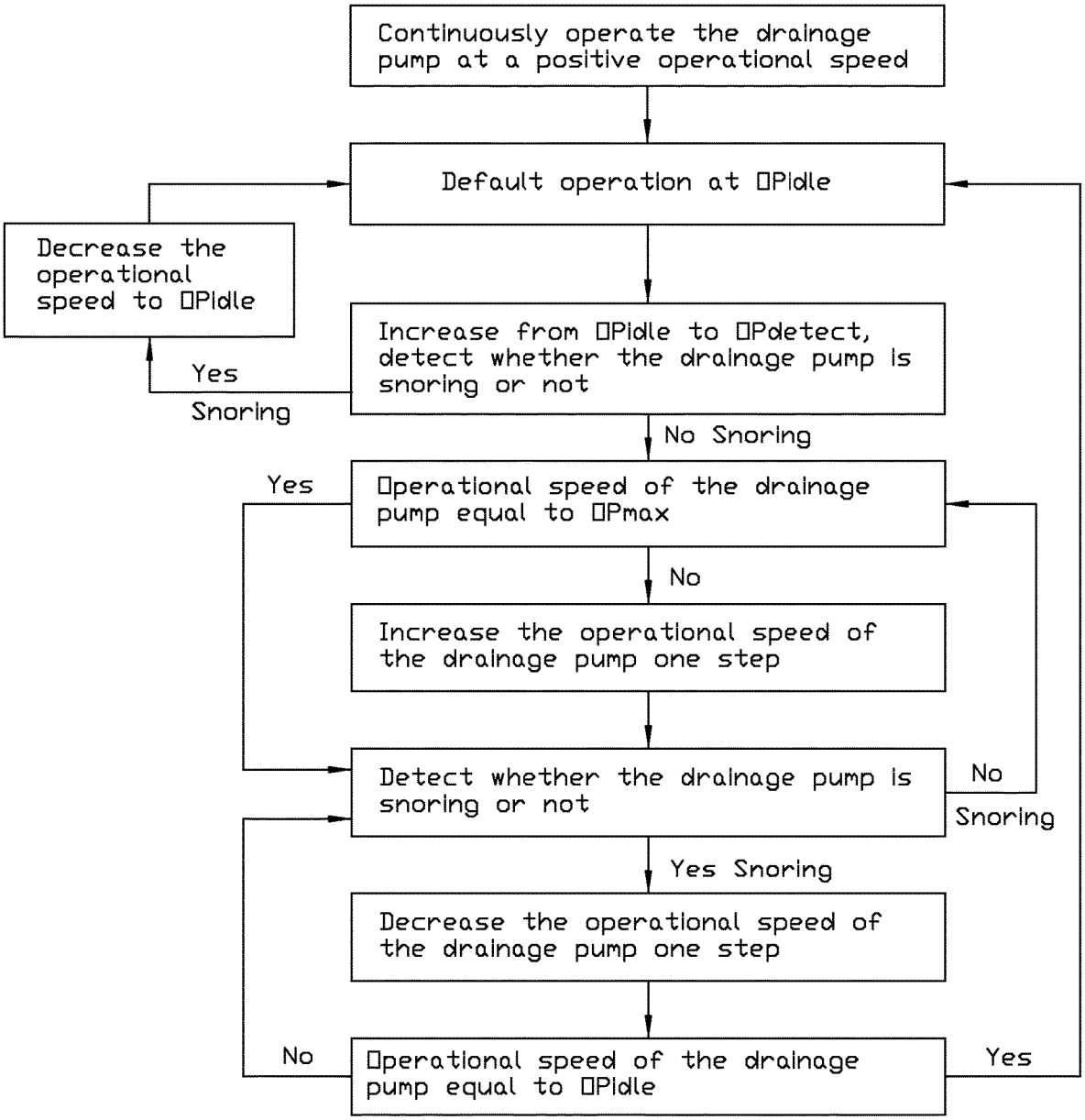
FIG. 2 is a schematic flow chart of the inventive method.

The inventive method for controlling a drainage pump 2 is schematically disclosed in FIG. 2 and comprises the essential steps of:

- continuously operating the drainage pump 2 at a positive operational speed, the impeller 9 being driven in rotation by said electric motor 7 in a positive direction of rotation,
- default operating the drainage pump 2 at an operational speed equal to a predetermined idle operational speed (OPidle), and
- periodically increasing the operational speed (OP) of the drainage pump 2 from the idle operational speed (OPidle) to a predetermined snoring detection threshold (OPdetect) and detecting whether the drainage pump 2 is snoring or not at the snoring detection threshold (OPdetect).

When snoring is detected at the snoring detection threshold (OPdetect), the operational speed (OP) of the drainage pump 2 is decreased to the idle operational speed (OPidle) whereby the default operation of the drainage pump 2 at the idle operational speed (OPidle) is resumed.

When snoring is not detected at the snoring detection threshold (OPdetect), proceed to stepwise change of the operational speed (OP) of the drainage pump 2 and at each new operational speed (OP) detecting whether the drainage pump 2 is snoring or not, wherein the stepwise change of the operational speed (OP) involves, i) increasing the operational speed (OP) one step each time snoring is not detected, at most up to a predetermined maximum operational speed (OPmax), and ii) decreasing the operational speed (OP) one step each time snoring is detected, at most down to the idle operational speed (OPidle) whereby the default operation of the drainage pump 2 at the idle operational speed (OPidle) is resumed.

It is central that the drainage pump 2 is continuously operating, i.e. that the impeller 9 is rotating in a positive direction. The positive direction of the rotation of the impeller 9 is equal to the direction of rotation used in order to pump liquid from the inlet 4 towards the outlet 6 of the drainage pump 2. Increasing the operational speed of a drainage pump 2 pumping liquid/water comprising solid matter, i.e. a slurry, from a low rotational speed in the positive direction requires much less energy than increasing the operational speed of the drainage pump 2 to the same level from stand still, especially due to the great moment of inertia that has to be overcome when starting such a drainage pump 2 from standstill. An even worse situation is to increase the operational speed of a drainage pump 2 in the positive direction from a forced rotation in the negative direction. This situation would arise if the drainage pump 2 is let to freewheel and the liquid flow backwards through the outlet conduit 3 and through the drainage pump 2 into the first basin 11, thereby the impeller 9 will be forced to rotate in the negative direction, as a water turbine. If the drainage pump 2 is instructed to increase the operational speed in the positive direction, directly from a negative rotation, the protective motor switch will release/trig. Thereto, it is an explicit requirement from the operators/customers that the drainage pump 2 shall always be operating/running, since a standstill in the mine due to a flooded horizontal gallery is extremely costly and thus the operators/costumers are more willing to have excessive wear on the drainage pumps than a stop in the production.

The step/activity of detecting whether the drainage pump 2 is snoring or not, may be performed using different techniques, independently or in combination with each other. The term "snoring" entails that the drainage pump 2 is operated in a snoring operational mode, i.e. the drainage pump 2 sucks a mixture of air and liquid into the inlet 4. The control unit 10 controls the drainage pump 2, at each moment/time, to have a predetermined operational speed.

A preferred embodiment to detect snoring is to monitor the power or current consumption of the drainage pump 2 using the control unit 10. If the power or current consumption of the drainage pump 2 starts to widely fluctuate outside a predetermined range and/or decrease below a predetermined threshold, the drainage pump 2 has started to snore and the control unit 10 detects a snoring condition.

An alternative embodiment to detect snoring is to monitor the torque of the drainage pump 2 using the control unit 10. If the torque of the drainage pump 2 starts to widely fluctuate outside a predetermined range and/or decrease below a predetermined threshold, the drainage pump 2 has started to snore and the control unit 10 detects a snoring condition.

Other alternative embodiments to detect snoring constitute monitoring one or more of sounds, vibrations, pressure at the outlet 6, etc. of the drainage pump 2.

The expression "default operation" is used to highlight that the inventive method strive to operate the drainage pump 2 at the idle operational speed (OPidle) as long as the water level is low enough.

The term "periodically", in connection with the recurrent and temporary increase to the snoring detection threshold (OPdetect), entails that there is a time interval between each increase up to the snoring detection threshold (OPdetect). According to a preferred embodiment the time interval is the same throughout the operation of the drainage pump 2. According to an alternative embodiment the time interval may differ throughout the day and/or week to match the work performed at the working site, i.e. if greater and more frequent variations in the liquid level are assumed/expected then the time interval can be shorter.

The snoring detection threshold (OPdetect) can be at any level between the idle operational speed (OPidle) and the maximum operational speed (OPmax). The higher the snoring detection threshold (OPdetect) the more efficient and reliable snoring detection, but at the same time more wear and more energy consumption. According to a preferred embodiment the snoring detection threshold (OPdetect) is equal to or higher than the minimum operational speed (OPmin), in order to obtain a reliable snoring detection. According to an alternative embodiment the snoring detection threshold (OPdetect) is lower than the minimum operational speed (OPmin) in order to limit wear and energy consumption. Preferably, the snoring detection threshold (OPdetect) is high enough to start to move water through the drainage pump 2 and into the outlet conduit 3 that is more or less empty if water is present at the inlet 4. It shall be realized that the operational speed capable of mowing water into the empty outlet conduit 3 is not necessarily high enough to be able to transport water through the entire outlet conduit 3, e.g. when the snoring detection threshold (OPdetect) is lower than the minimum operational speed (OPmin).

It shall be pointed out that the actual monitoring of any snoring operational mode may be continuous, but the specific actions of detecting shall be mutually separated in time. Preferably, the step of detecting whether the drainage pump 2 is snoring or not during the stepwise change of the operational speed (OP) is performed on or after 1 second from the time the operational speed (OP) starts to decrease or increase, and within 10 seconds from the time the operational speed (OP) starts to decrease or increase, preferably within 5 seconds. When the operational speed is changed the decrease or increase is made with a ramp, i.e. a gradually decrease or increase during a ramp time. After the ramp time it is preferred to let the drainage pump reach a steady state to minimize the risk of making incorrect determinations regarding snoring or not. In some applications it is better to make a quick decision, i.e. after 1 second, and with less certainty regarding the detection of snoring, and in other applications it is better to have greater certainty regarding the detection of snoring and wait a longer time, i.e. 5 or 10 seconds.

According to a preferred embodiment the predetermined time between start of decrease or increase and the detection whether the drainage pump is snoring during the stepwise change, is the same throughout the operation of the drainage pump 2. According to an alternative embodiment the time may differ throughout the day and/or week to match the work performed at the working site, i.e. if greater and more frequent variations in the liquid level are assumed/expected then the time is shorter.

The most essential features of the inventive method are that, every time snoring is detected the operational speed (OP) of the drainage pump 2 is decreased one step and every time snoring is not detected the operational speed (OP) of the drainage pump 2 is increased one step. More precisely, the output frequency from the control unit 10 to the electric motor 7 is decreased one step or increased one step, respectively, i.e. stepwise change of the operational speed. Thus, the essence of the invention is stepwise decrease of the operational speed of the drainage pump 2 when snoring is detected and stepwise increase of the operational speed of the drainage pump 2 when snoring is not detected. Thus, during the stepwise change of operational speed the inventive method performs a step of intermittently detect whether the drainage pump 2 is snoring or not.

Each step of the operational speed of the drainage pump 2 is equal to or more than 100 rpm, preferably equal to or more than 200 rpm. Thereto, each step of the operational speed of the drainage pump 2 is equal to or less than 500 rpm, preferably equal to or less than 400 rpm.

According to one embodiment said step of the operational speed of the drainage pump 2 is the same throughout the operation of the drainage pump 2. According to an alternative embodiment said step of the operational speed of the drainage pump 2 may differ throughout the day and/or week to match the work performed at the working site, i.e. if greater and more frequent variations in the liquid level are suspected the step is greater. Thereto, it shall be pointed out that according to a preferred embodiment the size of the step of the operational speed of the drainage pump 2 during decrease of the operational speed may be the same as or may differ from the step of the operational speed of the drainage pump 2 during increase of the operational speed. Preferably the decrease step is equal to 2, 3 or 4 times the increase step in order to get as quickly as possible to the idle operational speed OPidle when the water level is low.

During a typical operation of the drainage pump 2 the change of the operational speed of the drainage pump 2 is sometimes alternating between a step of increase and a step of decrease, and sometimes several steps of increase or several steps of decrease occur.

During operation of the drainage pump 2 the stepwise decrease of the operational speed is allowed at most down to a predetermined idle operational speed (OPidle). During normal operation of the drainage pump 2 the stepwise decrease of the operational speed is performed down to a predetermined minimum operational speed (OPmin), and if the drainage pump 2 is operated at the minimum operational speed (OPmin) and snoring is detected, then the operational speed of the drainage pump 2 is decreased down to the idle operational speed OPidle. However, it shall be realized that the operational speed must not reach the minimum operational speed OPmin before the operational speed is decreased to the idle operational speed OPidle, but can be decreased to the idle operational speed OPidle from operational speeds higher than the minimum operational speed OPmin. During normal operation of the drainage pump 2 the stepwise increase of the operational speed is allowed at most up to a predetermined maximum operational speed (OPmax). Thus, if the drainage pump 2 is operated at the maximum operational speed (OPmax) and snoring is not detected, then the operational speed of the drainage pump 2 is not changed.

The minimum operational speed (OPmin) is an operational speed of the drainage pump 2 at which the drainage pump 2 is still able to pump/transport liquid, i.e. at least keep the liquid in the outlet conduit 3 from rushing back into the first basin 11. Preferably, the predetermined minimum operation speed (OPmin) of the drainage pump 2 is equal to or more than 500 rpm, preferably equal to or more than 1000 rpm. Preferably, the predetermined minimum operation speed (OPmin) of the drainage pump 2 is equal to or less than 2000 rpm, preferably equal to or less than 1800 rpm.

The maximum operational speed (OPmax) is preferably an operational speed of the drainage pump 2 at which the drainage pump 2 is operated at the rated maximum frequency/operational speed, i.e. corresponding to direct online connection of the drainage pump 2. According to an alternative embodiment the maximum operational speed (OPmax) is an operational speed of the drainage pump 2 at which the drainage pump 2 is operated at a frequency greater than or less than the rated frequency. Preferably, the predetermined maximum operation speed (OPmax) of the drainage pump 2 is equal to or more than 2000 rpm, preferably equal to or more than 3000 rpm. The predetermined maximum operational speed (OPmax) is preferably equal to or less than 5000 rpm, preferably equal to or less than 4500 rpm. The higher rpm the more wear due to the wearing particles in the pumped liquid/media.

In connection with idle operational speed (OPidle), the drainage pump 2 perform no positive duty, i.e. the impeller 9 of the pump still turn in the positive direction but no liquid is pumped/transported. On the contrary, the liquid in the outlet conduit 3 may rush back into the first basin 11 via the drainage pump 2. The idle operational speed is used to reduce the wear and energy consumption of the drainage pump 2. Thereto, if air has been trapped about the impeller 9, this cushion of air may delude the control unit 10 to detect snoring even though the liquid level is high enough, and when the operational speed of the drainage pump 2 is temporarily decreased to the idle operational speed the air cushion will be removed by the liquid flushing the pump chamber of the drainage pump 2.

According to a preferred embodiment, the drainage pump 2 is operated at said idle operational speed (OPidle) equal to or longer than 5 second, preferably equal to or longer than 10 seconds. Preferably, the drainage pump 2 is operated at said idle operational speed (OPidle) equal to or less than 60 seconds, preferably equal to or shorter than 20 seconds. The operation at the idle operational speed (OPidle) can be as long as 20 minutes during times of the day/week without production at the location of the drainage pump 2.

During the idle operational sped (OPidle) no snoring detection takes place. According to a preferred embodiment, the idle operational speed (OPidle) of the drainage pump 2 is equal to or less than 500 rpm. Preferably equal to or less than 300 rpm, and most preferably equal to or less than 100 rpm. The idle operational speed (OPidle) is preferably as low as possible in order to save as much energy as possible. According to a preferred embodiment, the idle operational speed (OPidle) of the drainage pump 2 is equal to or more than 20 rpm, preferably equal to or more than 1 rpm. The idle operational speed (OPidle) is preferably equal to the rated minimum frequency/operational speed of the Variable Frequency Drive of the control unit 10.

Upon start of the drainage pump 2, the operational speed is preferably somewhere between the minimum operational speed (OPmin) and the maximum operational speed (OPmax), an initial snoring detection is performed and thereafter the inventive method is initiated.

The drainage pump assembly comprises means adapted to execute the steps of the above method. Many of the steps of the above method are preferably performed/controlled by the control unit 10, and thus the term "the drainage pump assembly comprises means . . . " does not necessarily imply that said means has to be located within the pump housing of the drainage pump 2. Thus the term also includes means accessible/available/operatively connected to the drainage pump 2.

A computer program product/package comprising instructions to cause the drainage pump 2 to execute the steps of the above method, is accessible/available/operatively connected to the drainage pump 2. Said computer program product is preferably located/run in the control unit 10. Thus, the control unit is configured to perform the inventive method.

Thereto, it shall be pointed out that the drainage pump preferably, by the choice of the operator, shall be arranged to alternatively be operated in common ON-OFF drive mode, i.e. the drainage pump is controlled by level sensors to start pumping at a liquid start level and stop pumping at a liquid stop level.

In expression "change the operational speed of the drainage pump" can be made by changing the output frequency of the Variable Frequency Drive a specific step of by changing the output frequency of the Variable Frequency Drive such that the power provided to the drainage pump is changed a specific step.

Feasible Modifications of the Invention

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design.

It shall also be pointed out that even thus it is not explicitly stated that features from a specific embodiment may be combined with features from another embodiment, the combination shall be considered obvious, if the combination is possible.

The invention claimed is:

1. A method for controlling a drainage pump configured to operate at a variable operational speed, the drainage pump comprising a drive unit comprising an electric motor and a drive shaft, and a hydraulic unit comprising an impeller operatively connected to the electric motor via the drive shaft, the method comprising the steps of:

operating continuously the drainage pump at a positive operational speed via the electric motor in rotation driving the impeller in a positive direction of rotation throughout the entire method;

conducting default operation of the drainage pump at an operational speed equal to a predetermined idle operational speed;

periodically increasing the operational speed of the drainage pump from the idle operational speed to a predetermined snoring detection threshold speed, and detecting whether the drainage pump is snoring or not snoring at the predetermined snoring detection threshold speed;

when snoring is detected at the predetermined snoring detection threshold speed, decreasing the operational speed of the drainage pump to the idle operational speed, and resuming the default operation of the drainage pump at the idle operational speed;

when snoring is not detected at the predetermined snoring detection threshold, proceeding to stepwise change the operational speed of the drainage pump, and to detect whether the drainage pump is snoring or not snoring at each new operational speed corresponding to each stepwise change; wherein the stepwise change of the operational speed (OP) involves:

increasing the operational speed by one increasing step increment each time snoring is not detected, up to a predetermined maximum operational speed; and decreasing the operational speed by one decreasing step increment each time snoring is detected, down to the idle operational speed, and resuming the default operation of the drainage pump at the idle operational speed.

2. The method of claim 1, wherein the drainage pump is configured to transport liquid at operational speeds equal to or higher than a predetermined minimum operational speed.

3. The method of claim 2, wherein the predetermined snoring detection threshold is equal to or higher than the minimum operational speed.

4. The method of claim 2, wherein the predetermined snoring detection threshold is lower than the minimum operational speed.

5. The method of claim 1, wherein when the operational speed is decreased to the idle operational speed the drainage pump is operated at the idle operational speed for a duration in a range of 5 to 60 seconds.

6. The method of claim 5, wherein the duration is in a range of 10 to 20 seconds.

7. The method of claim 5, wherein the idle operational speed comprises a speed at which the impeller rotates but the drainage pump does not transport liquid.

8. The method of claim 1, wherein detecting whether the drainage pump is snoring or not snoring during the stepwise change of the operational speed of the drainage pump is performed within a range of 1 to 10 seconds from when the operational speed starts to decrease or increase.

9. The method of claim 8, wherein the detecting is performed within a range of 1 to 5 seconds.

10. The method of claim 2, wherein when snoring is detected at the minimum operational speed, the operational speed is decreased from the minimum operational speed to the idle operational speed.

11. The method of claim 1, wherein the idle operational speed of the drainage pump is in a range of 1 to 100 revolution per minutes (RPM).

12. The method of claim 2, wherein the minimum operational speed is in a range of 500 to 2000 RPM.

13. The method of claim 1, wherein the maximum operational speed of the drainage pump is equal to or higher than 2000 RPM but less than or equal to 5000 rpm.

14. The method of claim 13, wherein the maximum operational speed of the drainage pump is equal to or higher than 2500 RPM but less than or equal to 5000 rpm.

15. The method of claim 1, wherein the decreasing step increment is greater than the increasing step increment.

16. A drainage pump assembly comprising:

a drainage pump comprising:

a drive unit, comprising an electrical motor and a drive shaft, a hydraulic unit, comprising an impeller operatively connected to the electric motor via the drive shaft; and a control unit operatively connected to the electric motor of the drainage pump;

wherein the drainage pump is configured to operate at a variable operational speed, and the control unit is configured to execute the steps of:

operating continuously the drainage pump at a positive operational speed via the electric motor in rotation driving the impeller in a positive direction of rotation throughout the entire execution of the steps;

conducting default operation of the drainage pump at an operational speed equal to a predetermined idle operational speed;

periodically increasing the operational speed of the drainage pump from the idle operational speed to a predetermined snoring detection threshold speed, and detecting whether the drainage pump is snoring or not snoring at the predetermined snoring detection threshold speed;

when snoring is detected at the predetermined snoring detection threshold speed, decreasing the operational speed of the drainage pump to the idle operational speed, and resuming the default operation of the drainage pump at the idle operational speed;

when snoring is not detected at the predetermined snoring detection threshold, proceeding to stepwise change the operational speed of the drainage pump, and to detect whether the drainage pump is snoring or not snoring at each new operational speed corresponding to each stepwise change; wherein the stepwise change of the operational speed (OP) involves:

increasing the operational speed by one increasing step increment each time snoring is not detected, up to a predetermined maximum operational speed; and decreasing the operational speed by one decreasing step increment each time snoring is detected, down to the idle operational speed, and resuming the default operation of the drainage pump at the idle operational speed.

17. The drainage pump assembly of claim 16, wherein the control unit is integrated into the drainage pump.

18. The drainage pump assembly of claim 16, wherein the control unit comprises a Variable Frequency Drive (VFD).

19. The drainage pump assembly of claim 18, wherein the idle operation speed corresponds to a minimum operational speed of the variable frequency drive.

20. A computer program product comprising a non-transitory computer-readable medium storing a program including instructions that, when executed by a control unit of a drainage pump assembly, causes the drainage pump assembly to execute the steps of:

operating continuously the drainage pump at a positive operational speed via the electric motor in rotation driving the impeller in a positive direction of rotation throughout the entire execution of the steps;

conducting default operation of the drainage pump at an operational speed equal to a predetermined idle operational speed;

periodically increasing the operational speed of the drainage pump from the idle operational speed to a predetermined snoring detection threshold speed, and detecting whether the drainage pump is snoring or not snoring at the predetermined snoring detection threshold speed;

when snoring is detected at the predetermined snoring detection threshold speed, decreasing the operational speed of the drainage pump to the idle operational speed, and resuming the default operation of the drainage pump at the idle operational speed;

when snoring is not detected at the predetermined snoring detection threshold, proceeding to stepwise change the operational speed of the drainage pump, and to detect whether the drainage pump is snoring or not snoring at each new operational speed corresponding to each stepwise change; wherein the stepwise change of the operational speed (OP) involves:

increasing the operational speed by one increasing step increment each time snoring is not detected, up to a predetermined maximum operational speed; and decreasing the operational speed by one decreasing step increment each time snoring is detected, down to the idle operational speed, and resuming the default operation of the drainage pump at the idle operational speed.

* * * * *